US008016515B2

(12) United States Patent
Benedetti et al.

(10) Patent No.: US 8,016,515 B2
(45) Date of Patent: Sep. 13, 2011

(54) RECYCLING ASPHALT APPARATUS

(75) Inventors: Albert Benedetti, Broadview Heights, OH (US); John Stockwell, Maple Heights, OH (US)

(73) Assignee: Angelo Benedetti Inc., Bedford, OH (US)

( * ) Notice: Subject to any disclaimer, the term of this patent is extended or adjusted under 35 U.S.C. 154(b) by 72 days.

(21) Appl. No.: 12/564,300

(22) Filed: Sep. 22, 2009

(65) Prior Publication Data

US 2010/0074684 A1 Mar. 25, 2010

Related U.S. Application Data

(60) Provisional application No. 61/192,757, filed on Sep. 22, 2008.

(51) Int. Cl.
*E01C 23/08* (2006.01)

(52) U.S. Cl. ..... 404/94; 299/87.1

(58) Field of Classification Search ..... 404/75, 404/77, 79–87, 91–95, 103, 105, 122, 124; 299/87.1

See application file for complete search history.

(56) References Cited

U.S. PATENT DOCUMENTS

| | | | | | |
|---|---|---|---|---|---|
| 2,594,256 | A * | 4/1952 | Compton | 299/87.1 |
| 2,948,520 | A * | 8/1960 | Densmore | 299/55 |
| 3,395,941 | A * | 8/1968 | Carothers et al. | 299/87.1 |
| 3,461,579 | A * | 8/1969 | Turner | 37/189 |
| 3,907,582 | A * | 9/1975 | Walter | 106/284.01 |
| 3,962,803 | A * | 6/1976 | O'Brien | 37/319 |
| 4,280,732 | A * | 7/1981 | Haspert | 299/11 |
| 4,436,346 | A * | 3/1984 | Best et al. | 299/87.1 |
| 5,052,757 | A * | 10/1991 | Latham | 299/87.1 |
| 5,120,112 | A * | 6/1992 | Kincaid | 299/67 |
| 5,536,073 | A * | 7/1996 | Sulosky et al. | 299/39.8 |
| 7,785,033 | B2 * | 8/2010 | Boyd | 404/75 |
| 2003/0175080 | A1 * | 9/2003 | Bruso | 405/128.1 |
| 2007/0172313 | A1 * | 7/2007 | Lopez | 404/77 |
| 2008/0036271 | A1 * | 2/2008 | Hall et al. | 299/87.1 |
| 2008/0315666 | A1 * | 12/2008 | Von Schonebeck et al. | 299/39.6 |

* cited by examiner

*Primary Examiner* — Raymond W Addie
(74) *Attorney, Agent, or Firm* — McDonald Hopkins LLC

(57) ABSTRACT

An apparatus for repaving an asphalt surface is provided. The apparatus includes a base carried on a plurality of wheels, a heater to heat and soften a damaged asphalt surface, a series of blades and a center mill to scarify and break up the heated asphalt surface, and a mixer to receive and recondition the reclaimed asphalt. The center mill may include a plurality of teeth members to break up the asphalt and a plurality of lip members and paddles to lift the broken asphalt and deliver it to the mixer.

20 Claims, 8 Drawing Sheets

RECYCLING ASPHALT APPARATUS

CROSS-REFERENCE TO RELATED APPLICATION

This application claims benefit from U.S. Provisional Patent Application No. 61/192,757, entitled "Apparatus for Recycling Asphalt," filed on Sep. 22, 2008, which is hereby incorporated by reference in its entirety.

BACKGROUND

Asphalt (and other surface pavement materials such as macadam and tarmac) covers many surfaces such as roadways, runways and parking lots. Over time, wear and tear from vehicle traffic, weather, and oxidation, occurs and leads to cracks, bumps, dips, ruts and other irregularities in the asphalt. These unwanted formations are both an eyesore and a safety hazard that is dangerous to traffic.

There are a number of ways to refinish asphalt surfaces and to remove the unwanted irregularities. For example, a common method for repairing damaged asphalt includes removing the damaged asphalt from a surface and replacing it with new asphalt. The old asphalt is discarded and new asphalt material is used to refinish the surface. While this method is effective in renewing damaged asphalt surfaces, it is neither cost efficient nor environmentally friendly.

To address environmental and cost issues, systems have been developed that recycle at least a portion of the removed asphalt and reapply it to the refinished surface. These systems reduce material costs, eliminate waste and dumping costs, and are more environmentally conscious. These systems, however, do not effectively break up, remove, and reuse all existing asphalt and still typically requires the use of new asphalt.

One method of recycling and reapplying asphalt is Hot In-Place Recycling ("HIR"). Unlike cold recycling methods, HIR involves a first step of heating the damaged asphalt to soften the upper layer to a predetermined depth. Exemplary methods of heating asphalt are disclosed in U.S. Pat. No. 3,970,404. The heated layer of damaged asphalt is then removed through a scarification process. Commonly, between one and two inches of the top layer is removed during scarification. The removed asphalt is fed to a mixer that sifts out large, unusable pieces of asphalt, leaving only small, workable pieces. New material or reconditioning agents may be added to the reclaimed asphalt during the mixing process. The combination of old material and new additives is heated to enhance blending. The new mixture is then reapplied to the surface and compacted and smoothed by a steamroller while the surface is still hot.

HIR is an effective method for recycling damaged asphalt. However, several limitations exist in traditional HIR methods. One drawback is that multiple separate machines are traditionally required to perform the HIR process, including heating machines, scarifying machines, repaving machines and smoothing machines. The multiple machines increase both time and cost of repaving jobs. Another drawback is that the process of recycling and repaving asphalt is very slow, often moving at speeds of less than 10 feet per minute. Further, HIR is an inferior system for removing and reclaiming the damaged asphalt and requires more additives for the recycled asphalt. Thus, a need exists for an improved method and system for recycling and reapplying asphalt.

SUMMARY

An apparatus for repaving an asphalt surface is provided. The apparatus includes a base carried on a plurality of wheels and a center mill connected to the base. The center mill may include a plurality of teeth members to break up the asphalt surface and a plurality of lip members and paddles to lift the broken asphalt.

In an embodiment the apparatus includes additional components to assist in reconditioning the asphalt surface. For example, the apparatus may include a heater to heat and soften the damaged asphalt surface. The apparatus may further include a series of circular blades to scarify the asphalt surface and funnel broken asphalt towards the center mill. A mixer may be connected to the base to receive reclaimed asphalt and recondition the reclaimed asphalt to be reapplied to the surface.

DESCRIPTION OF THE DRAWINGS

Objects and advantages together with the operation of the invention may be better understood by reference to the following detailed description taken in connection with the following illustrations, wherein.

DETAILED DESCRIPTION OF THE PREFERRED EMBODIMENTS

Figure 1:
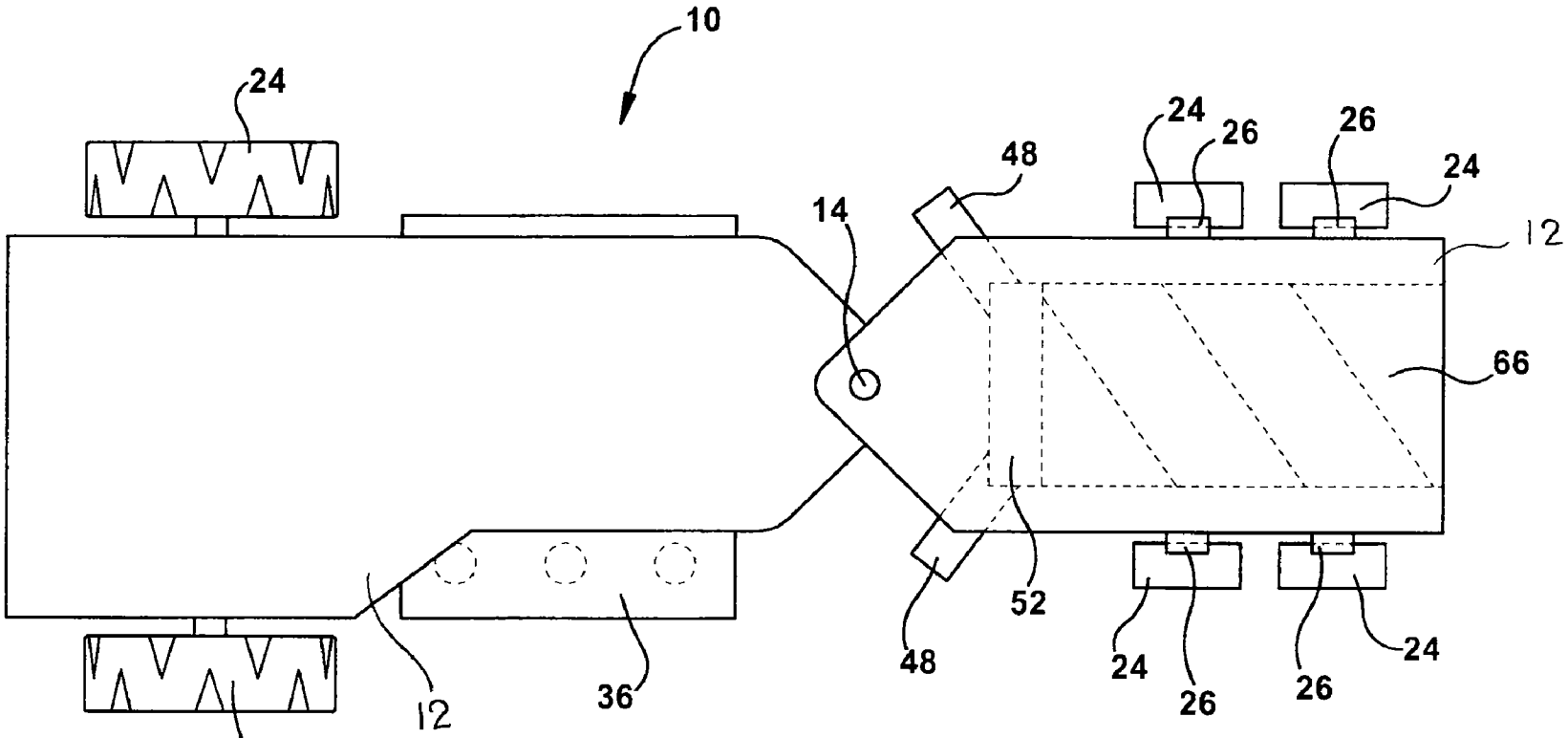
FIG. 1 illustrates a top view of an asphalt recycling machine.
Figure 2:
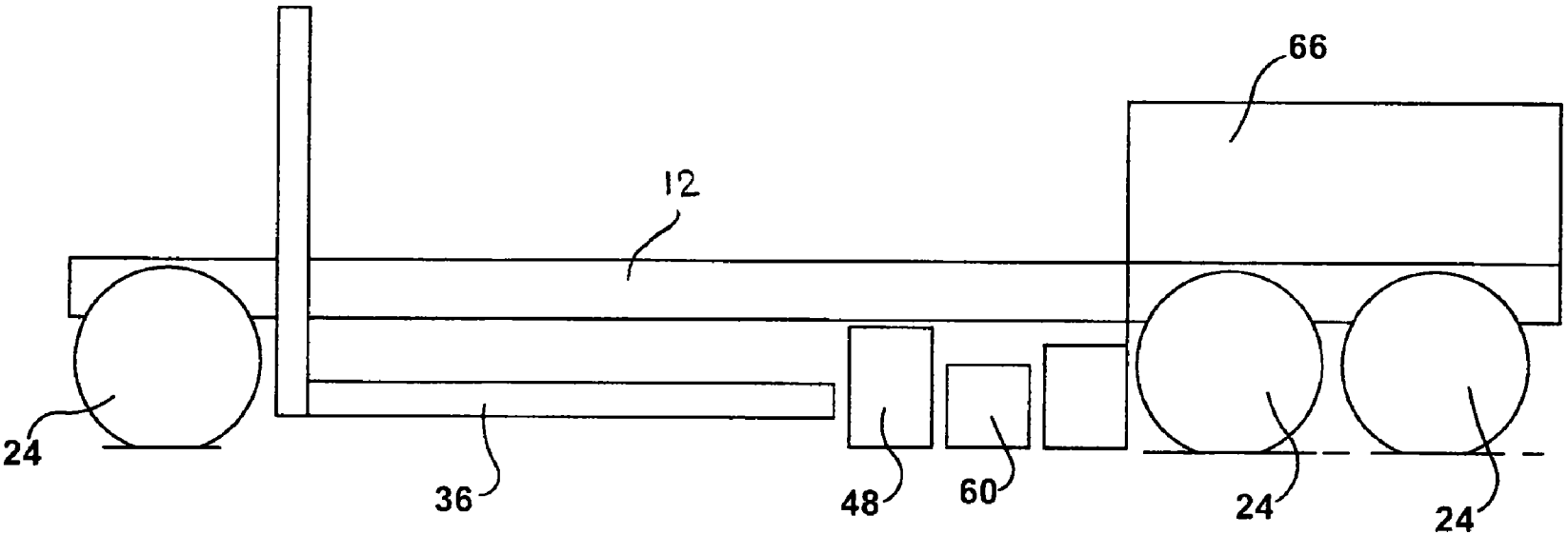
FIG. 2 illustrates a side view of an asphalt recycling machine.

An apparatus and method for reconditioning and recycling an asphalt surface is provided. The apparatus 10, as illustrated in FIG. 1, includes a base 12 for supporting various components to reclaim and recycle an asphalt surface. An example arrangement of the components of the apparatus 10 is shown in FIG. 2.

The base 12 may include a plurality of frame structures connected together. For example, the base 12 may include a first frame structure connected to a second frame structure as shown in FIG. 1. Alternatively, the base 12 may comprise a single unitary frame structure to support the various components. Moreover, it will be understood that the apparatus may include any number of frame structures.

Figure 3B:
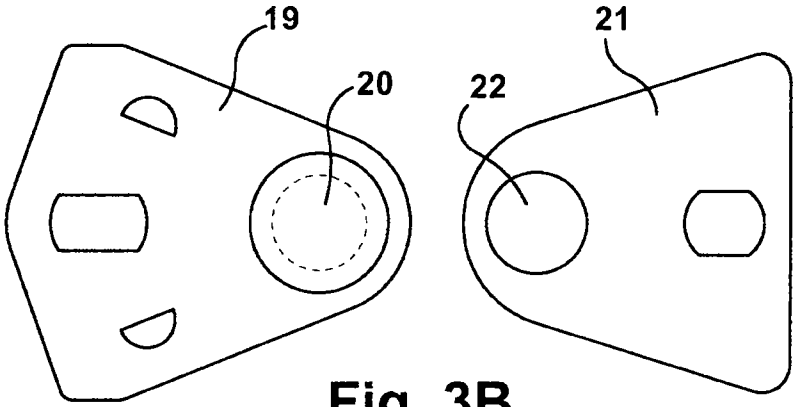
FIG. 3B illustrates a pair of end covers associated with an asphalt recycling machine.
Figure 3A:
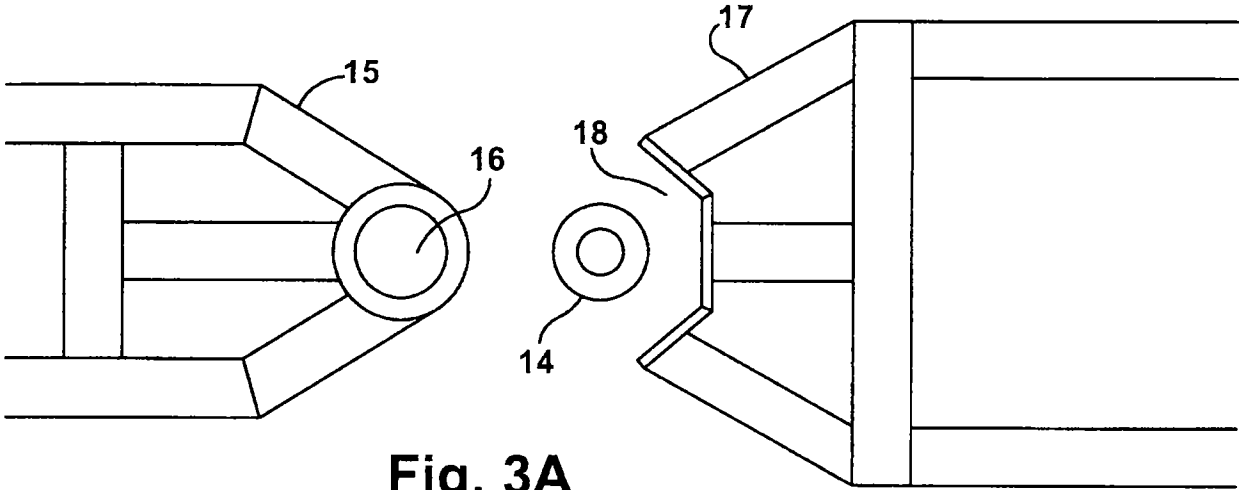
FIG. 3A illustrates a pair of frame structures and an articulation pin associated with an asphalt recycling machine.

The frame structures may be connected by an articulation pin 14. (FIGS. 3A and 3B.) For example, the first frame structure may include a first tapered section 15 having an opening 16. The opening 16 may be configured to receive a connecting device, such as the articulation pin 14, therein. The second frame structure may include a second tapered section 17 having an opening 18. As shown in FIG. 3B, a first cover 19 having an opening 20 may connect to the first tapered section 15 such that opening 16 and opening 20 are aligned. A second cover 21 having an opening 22 may connect to the second tapered section 17 such that opening 18 and opening 22 are aligned. The first tapered section 15 may be configured to engage the second tapered section 20 such that openings 16 and 20 are aligned with openings 18 and 22 to receive the articulation pin 14. The articulation pin 14 may be inserted through the openings 16, 18, 20, 22 thereby connecting the two frame structures and allowing the frame structures to swivel about the articulation pin 14.

The apparatus 10 also include a plurality of wheels 24. For example, the apparatus 10 may include two front wheels 24 and two rear wheels 24. The apparatus 10 may alternatively include two front wheels 24 and four rear wheels 24. (FIG. 1.) The apparatus 10 may include a means for driving the wheels 24 such as an engine coupled to a transmission and a drive shaft.

Figure 4:
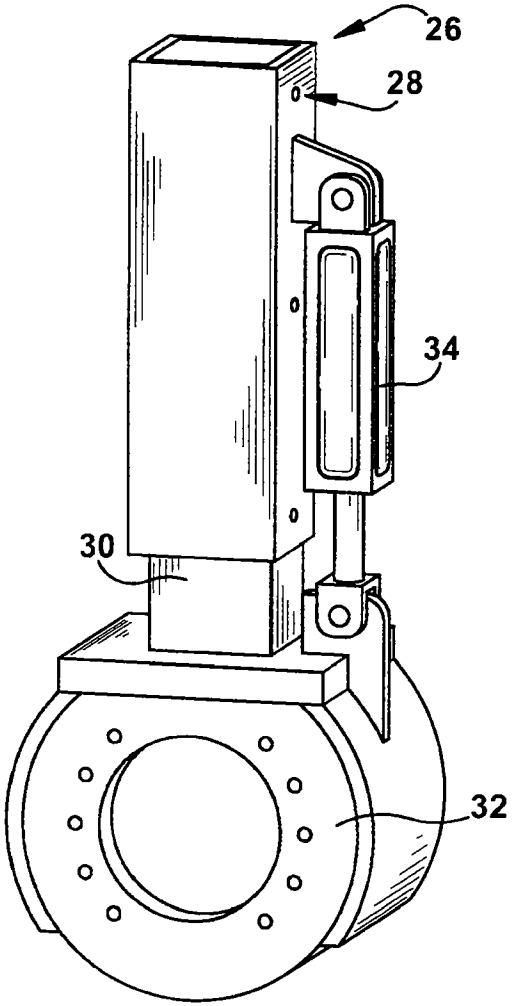
FIG. 4 illustrates a wheel lift associated with an asphalt recycling machine.

The apparatus 10 may include a wheel lift 26 connected to one or more wheels 24 to adjust the distance between the base and the asphalt surface. (FIG. 4.) The wheel lift 26 may include an outer housing 28 and an inner member 30 positioned within the outer housing 28. A wheel mount 32, configured to receive the wheel 24, may connect to the inner member 30. The outer housing 28 may connect to the base 12. The wheel lift 26 includes a lifting mechanism, such as a cylinder 34, to adjust the distance between the wheel 24 and the base 12. The cylinder 34 may connect to the outer housing 28 at a first end and the inner member 30 at a second end. As the cylinder is adjusted, the inner member 30 moves telescopically with the outer housing 28 to adjust the height of the apparatus 10. In an embodiment, the cylinder 34 may be a hydraulic cylinder. Alternatively, the cylinder 34 may be a pneumatic cylinder or other type of cylinder known to those having skill in the art. The apparatus 10 may include a pump connected to the cylinder 34. The cylinder 34 may be adjusted by altering pressure applied by the pump. In an embodiment, each wheel lift cylinder 34 may be separately controlled to allow each wheel 24 to operate at a desired height.

Figure 5:
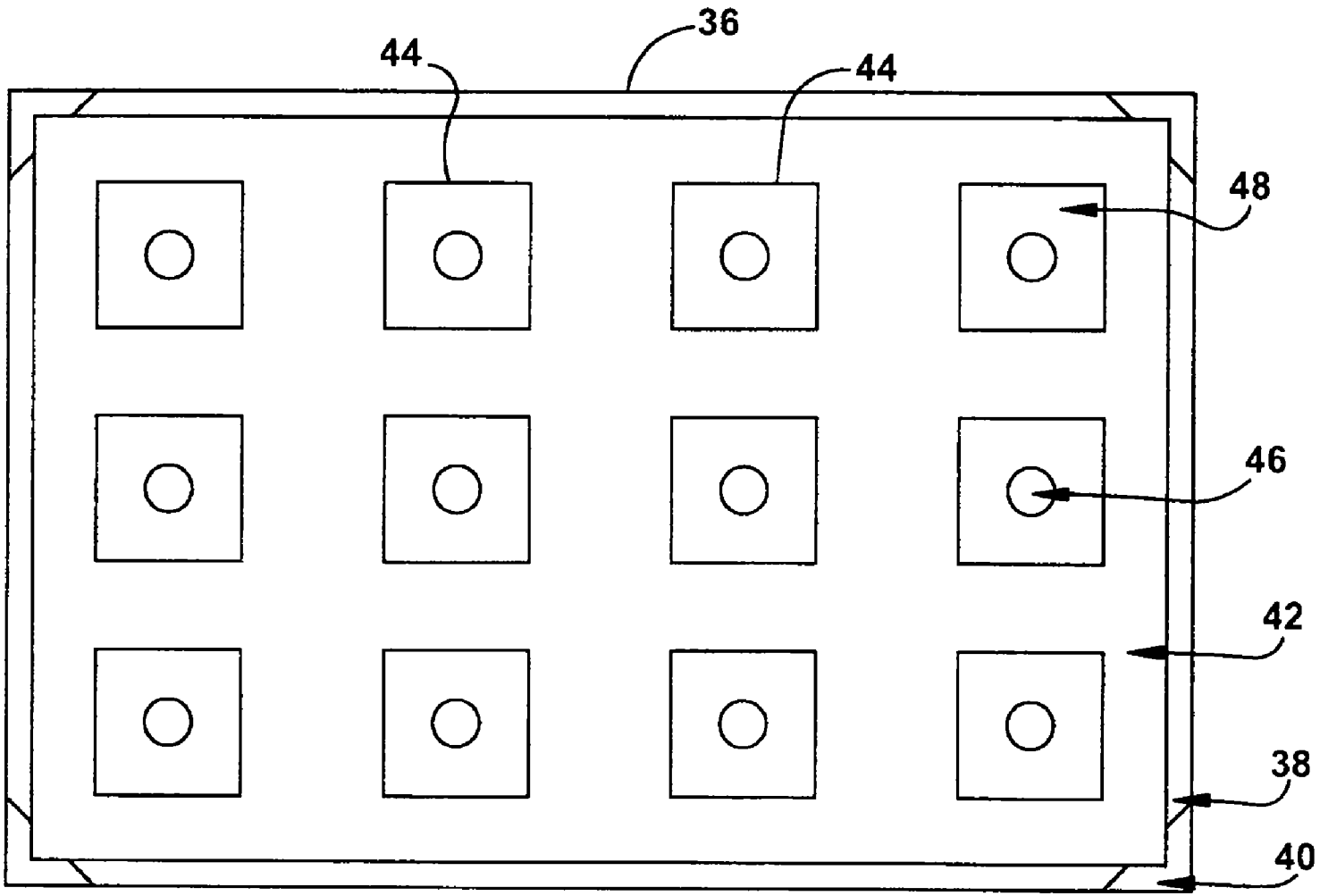
FIG. 5 illustrates a heater associated with an asphalt recycling machine.

The apparatus 10 includes a heater 36 connected to the base. (FIG. 5.) The heater may heat and soften the damaged asphalt surface. The heater 36 consists of a steel frame 38 and steel support corners 40 configured to support a fiber insulation 42. A plurality of burners 44 may be dispersed within the fiber insulation 42. The burners 44 may be ceramic burners, or other types of burners known in the art. Each burner may include a burner tube 46 housed within a fiber block 47. The heater 36 may be positioned angle each burner tube 46 towards the asphalt surface. The apparatus 10 may include a fuel source, such as liquid propane. In one embodiment, the fuel source is mixed with air at a ratio of 50% fuel and 50% air. The mixture is directly plumbed to the burners 44 to generate heat. The heater 36 temperature may be adjustable to heat the asphalt to the desired depth.

Figure 6:
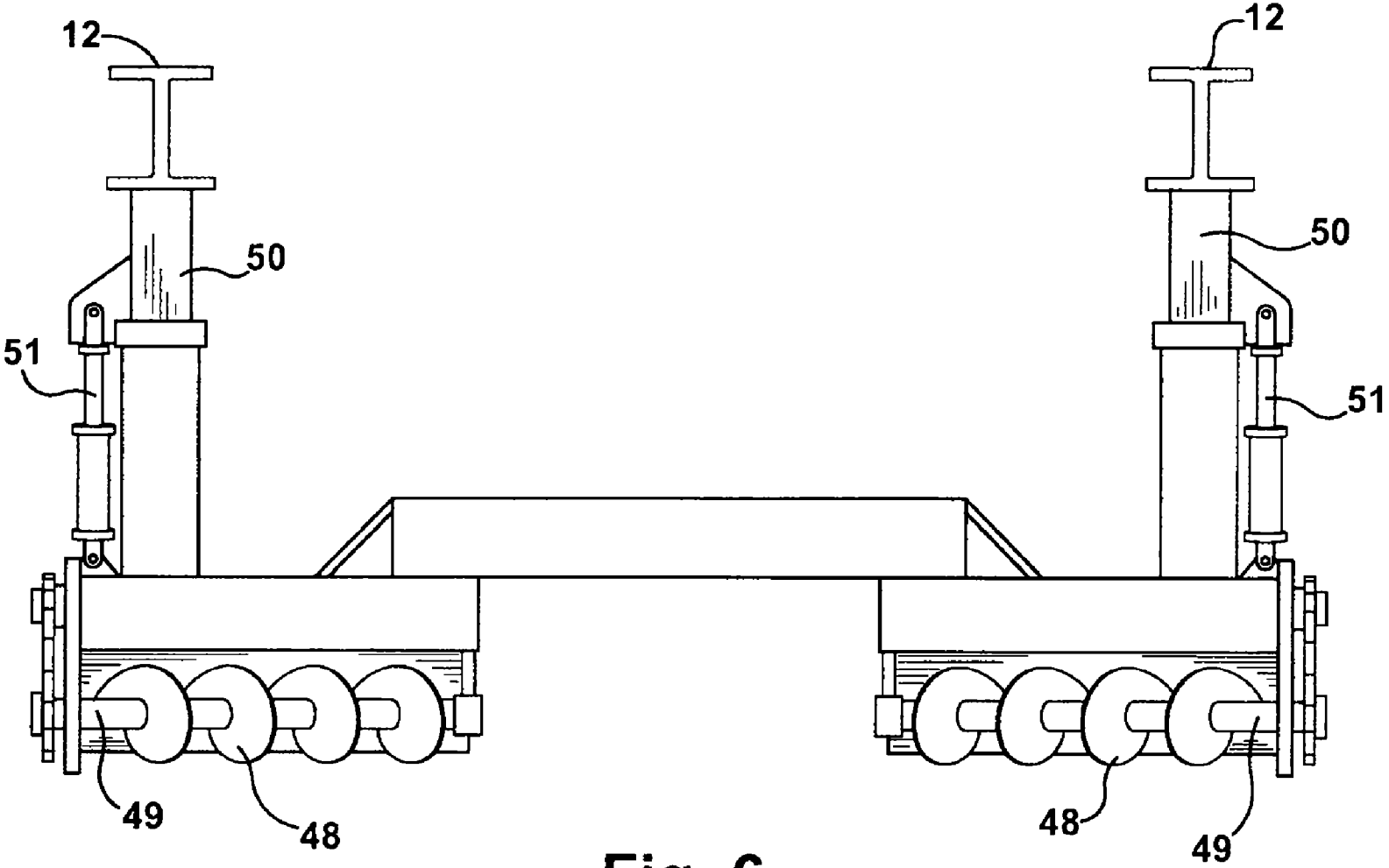
FIG. 6 illustrates a series of blades associated an asphalt recycling machine.

The apparatus 10 includes a series of blades 48 for scarifying the heated asphalt surface. (FIG. 6.) The blades 48 may be circular or spiral in shape and connected to a blade axis 49. Each series of blades 48 may be connected to the base 12 by a slip-fit apparatus 50. The blades may be raised or lowered by a cylinder 51 connected to the slip-fit apparatus 50. For example, cylinder 51 may be extended to lower the blades 48 to engage, lift and dislodge the heated asphalt without fracturing the aggregate material, thus retaining the structural integrity of the asphalt surface.

The blades 48 may be configured to channel the dislodged asphalt towards the center of the apparatus 10. For example, the circular blades 48 may be spirally connected around the blade axis 49 and configured to rotate about the blade axis 49. The rotating spiral blades 48 push dislodged asphalt towards the center of the apparatus 10. The apparatus 10 may include two series of blades 48. The blades 48 may be arranged at an angle to funnel the dislodged asphalt towards the center of the apparatus 10. For example, the portion of the blades 48 adjacent to the cylinder 51 may be positioned towards the front of the apparatus 10 and the portion of the blades 48 near the center of the apparatus 10 may be positioned towards the rear of the apparatus 10. This angled configuration allows the dislodged asphalt to be funneled towards the center of the apparatus 10.

Figure 7:
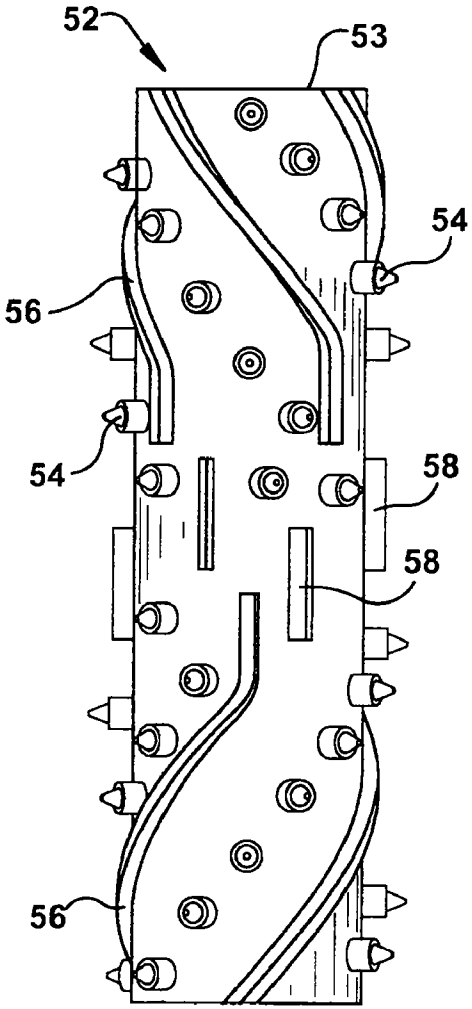
FIG. 7 illustrates a center mill associated with an asphalt recycling machine.

The apparatus 10 includes a center mill 52 for breaking up the dislodged asphalt. (FIG. 7.) The center mill 52 includes a mill body 53 with one or more teeth members 54, one or more lip members 56, and one or more center paddles 58 connected to a mill body 53. The teeth members 54 have sharpened tips protruding from the mill body 53. The lip members 56 and center paddles 58 may be flat members, protruding from the mill body 53. The center paddles 58 may be integral with the lip members 56 or the center paddles 58 may be unitary members.

The teeth members 54 may be arranged in a spiral row configuration along the mill body 53. (FIG. 7.) The lip members 56 also may be arranged in a spiral row configuration and dispersed between the spiral rows of teeth members 54. (FIG. 7.) The lip members 56 may be discontinuous near a central portion of the mill body 53. The mill 52 may include one or more center paddles 58 located at about the center of the mill body 53. (FIG. 7.) The center paddles 58 may be positioned parallel with the longitudinal axis of the mill 52.

The center mill 52 is configured to rotate onto the asphalt surface. For example, the mill body 53 may be generally cylindrical in shape and configured to rotate about its axis. However, it will be appreciated that the mill body 53 may also be any shape capable of rotating with respect to the asphalt surface. The center mill 52 may further be configured to receive scarified asphalt from the blades 48. For example, as the center mill 52 rotates, the teeth members 54 may crush heated asphalt into small pieces. The lip members 56 and center paddles 58 may lift the crushed asphalt and deliver it to other components of the apparatus 10, such as a conveyor (not shown) to be sifted and treated.

Figure 8:
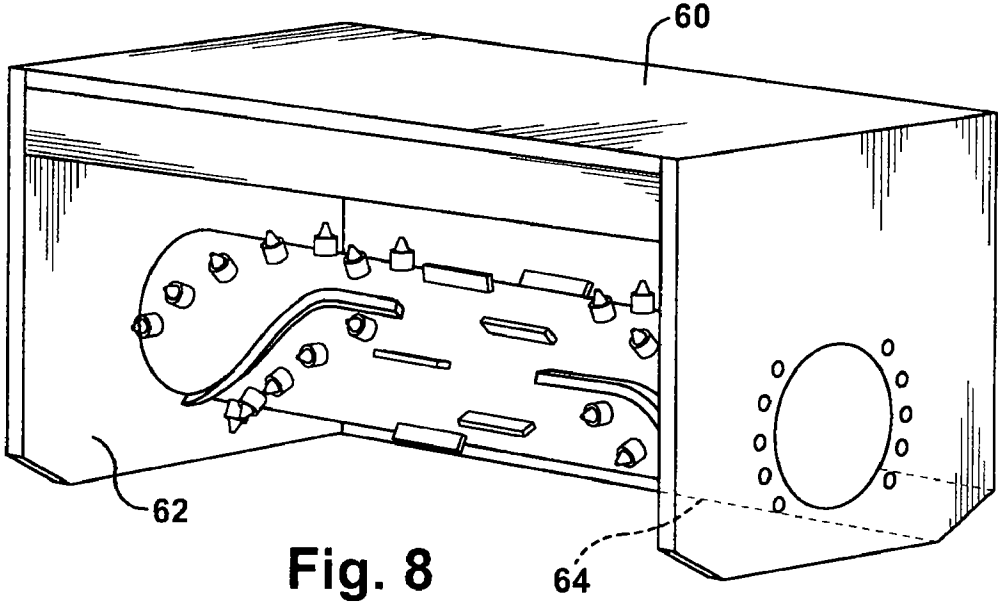
FIG. 8 illustrates a center mill and mill box associated with an asphalt recycling machine.

The center mill 52 may be connected to a mill box 60. (FIG. 8.) For example, a first end of the mill 52 may be connected to a first inner wall 62 of the mill box 60, and a second end of the center mill 52 may be connected to a second inner wall 64 of the mill box 60. Each end of the center mill 52 may be rotatably secured to its respective inner wall 62, 64, such that the center mill 52 is capable of rotating about its axis.

The mill box 60 may be open on at least one side to partially expose the center mill 52. The mill box 60 may be connected to the base 12 and configured such that an open side of the mill box 60 faces the asphalt surface, allowing the center mill 52 to receive scarified asphalt from the blades 48.

Figure 9:
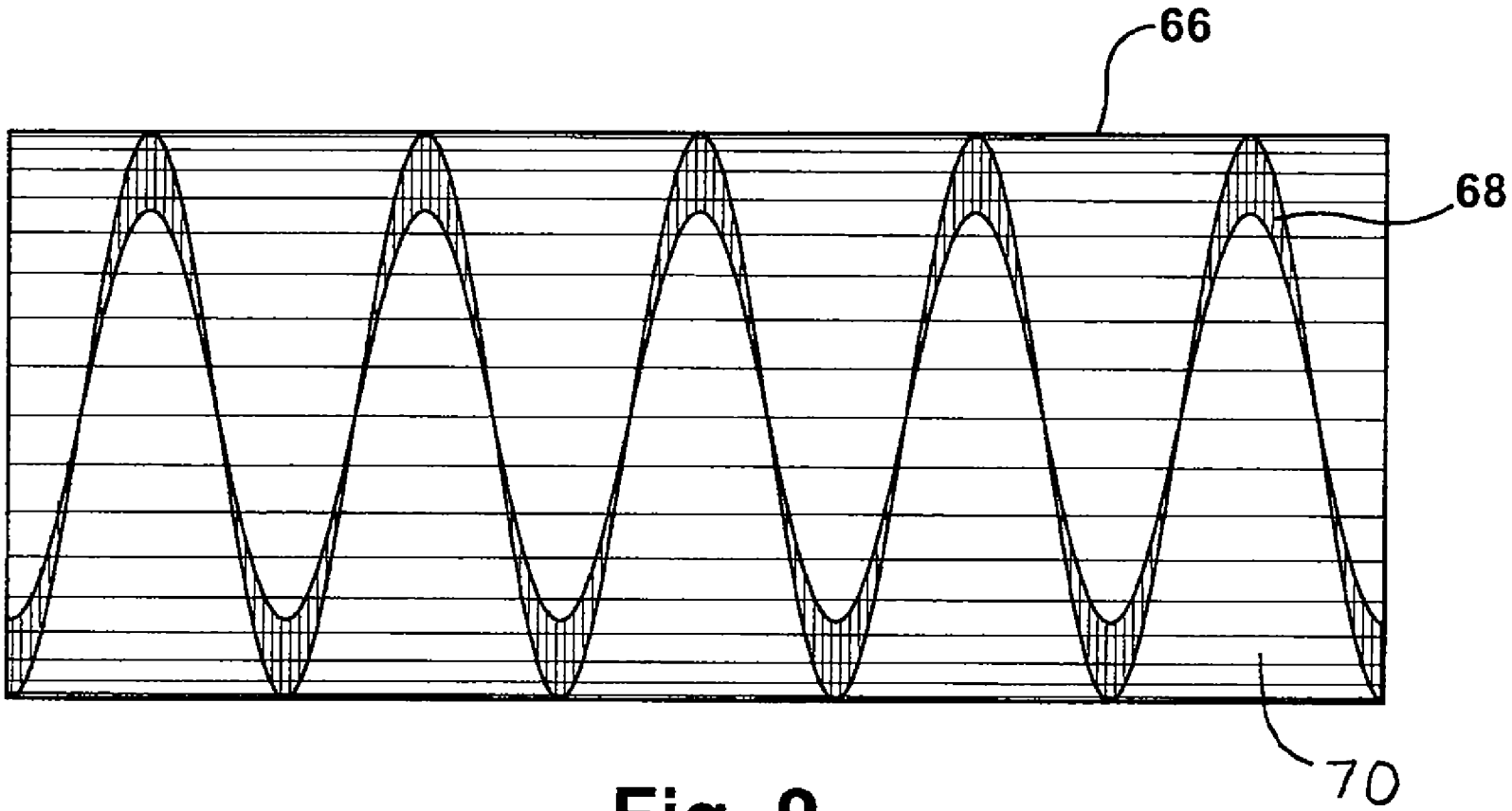
FIG. 9 illustrates a mixer associated with an asphalt recycling machine.

The apparatus 10 includes a mixer 66 for reconditioning the reclaimed asphalt. (FIG. 9.) The mixer 66 may be mounted to the base 12 and configured to receive asphalt from the mill 52. In an embodiment, the mixer 66 is mounted parallel to the surface being refinished. The mixer may be cylindrical in shape, with a hollow body. A spiral shaped trommel 68, similar to a screw conveyor, may be mounted to the interior of the mixer 66. The trommel 68 may include a screen portion 70 to separate usable reclaimed asphalt from unusable reclaimed asphalt. It will be appreciated that the mixer 66 and trommel 68 can have any number of shapes or configurations to maximize mixing the reclaimed asphalt. The mixer 66 may further mix the reclaimed asphalt with a chemical composition such as an emulsifier. The composition may be inserted into the mixer 66, such as by a sprayer or injector (not shown.) The emulsifier may be a rejuvenating oil emulsifier having the trade name Cyclogen ME from D and D Emulsions. Sprayers or injector known in the art may be connected to the mixer to add the reconditioning agents to the usable reclaimed asphalt. The mixer 66 may further include a heater, such as a burner tube, extending along length of the mixer.

In use, the apparatus 10 moves over the asphalt surface to be refinished. The heater 36 applies heat to soften a top layer of asphalt. Blades 48 engage the asphalt surface to lift and dislodge the heated layer of asphalt. The blades 48 feed the dislodged asphalt to the center mill 52. The teeth members 54 of the rotating center mill 52 also lift and dislodge the asphalt and further break up the asphalt into small pieces. The lip members 56 and center paddles 58 receive the dislodged asphalt and feed it into the mixer 66. The trommel inside the mixer 66 separates small workable pieces of reclaimed asphalt from larger, unworkable pieces of reclaimed asphalt. The mixer 66 also mixes the reclaimed asphalt with a composition such as an emulsifier. The reclaimed asphalt may be further heated, and reconditioning agents or new material may be added. The reconditioned asphalt is deposited from the mixer 66 back onto the milled surface. Typical systems and methods such as steamrolling, compaction, or other rolling means may be used to smooth out and compact the reconditioned asphalt.

The invention has been described with reference to the embodiments. Obviously, modifications and alternations will occur to others upon a reading and understanding of this specification. The claims as follows are intended to include all modifications and alterations insofar as they come within the scope of the claim or an equivalent thereof.

We claim:

1. An apparatus for treating an asphalt surface comprising:
- a base connected to a plurality of wheels; and
- a center mill connected to said base, said center mill comprising:
  - a cylindrical body;
  - a plurality of teeth members protruding from said cylindrical body and arranged in one or more rows extending around the cylindrical body, wherein said teeth members are capable of breaking up said asphalt surface;
  - a plurality of flat lip members protruding from said cylindrical body and positioned between said rows of teeth members, wherein said flat lip members are capable of lifting broken pieces of asphalt surface; and
  - a plurality of center paddles protruding from a central portion of said cylindrical body and positioned between said flat lip members to lift, wherein said center paddles are capable of lifting broken pieces of asphalt surface.

2. The apparatus of claim 1 wherein said teeth members are capable of engaging and breaking up said asphalt surface.

3. The apparatus of claims 2 wherein said flat lip members and center paddles are capable of lifting said broken asphalt.

4. The apparatus of claim 1 further comprising a heater.

5. The apparatus of claim 4 wherein said heater utilizes a fuel mixture ratio of 50% fuel and 50% air.

6. The apparatus of claim 1 wherein at least a portion of said plurality of teeth members are arranged in a spiral configuration.

7. The apparatus of claim 1 wherein said center paddles are arranged around a central portion of said cylindrical body.

8. The apparatus of claim 1 further comprising a series of circular blades connected to said base.

9. The apparatus of claim 8 comprising a first series of circular blades connected to said base on a first side of said center mill and a second series of circular blades connected to said base on a second side of said center mill.

10. An apparatus for treating an asphalt surface comprising:
- a base connected to a plurality of wheels;
- a center mill connected to said base, said center mill comprising:
  - a cylindrical body;
  - a plurality of teeth members protruding from said cylindrical body and arranged in one or more rows extending around the cylindrical body, said teeth members capable of breaking up said asphalt surface;
  - a plurality of flat lip members protruding from said cylindrical body and positioned between said rows of teeth members, wherein said flat lip members are capable of lifting broken pieces of asphalt surface; and
  - a plurality of flat center paddles protruding from a central portion of said cylindrical body and positioned between said flat lip members, wherein said center paddles are capable of lifting broken pieces of asphalt surface;
- a mixer connected to said base, said mixer comprising:
  - a housing including a screen portion;
  - a trommel mounted within said housing;
- wherein said mixer is capable receiving broken pieces of said asphalt surface and reconditioning said pieces of said asphalt surface to be reapplied to said surface.

11. The apparatus of claim 10 wherein said mixer includes a burner tube extending along a length of said mixer.

12. The apparatus of claim 10 wherein said mixer includes a device for injecting emulsifiers into said mixer.

13. The apparatus of claim 10 further comprising a heater connected to said base.

14. The apparatus of claim 13 wherein said heater utilizes a fuel mixture ratio of 50% fuel and 50% air.

15. An apparatus for treating an asphalt surface comprising:
- a base connected to a plurality of wheels;
- a wheel lift connected to at least one of said wheels, said wheel lift comprising a first housing connected to said base, a second housing connected to said wheel and a cylinder, wherein said cylinder is capable of changing the distance between said wheel and said base; and
- a center mill connected to said base, said center mill comprising:
  - a cylindrical body;
  - a plurality of teeth members protruding from said cylindrical body and arranged in one or more rows extending around the cylindrical body, wherein said teeth members are capable of breaking up said asphalt surface;
  - a plurality of flat lip members protruding from said cylindrical body and positioned between said rows of teeth members, wherein said flat lip members are capable of lifting broken pieces of asphalt surface; and
  - a plurality of center paddles protruding from a central portion of said cylindrical body and positioned between said flat lip members, wherein said center paddles are capable of lifting broken pieces of asphalt surface.

16. The apparatus of claim 15 wherein at least two of said wheels include a wheel lift connected thereto.

17. The apparatus of claim 16 wherein each of said wheel lifts is capable of being independently adjusted.

18. The apparatus of claim 15 wherein said base is comprised of a first frame portion and a second frame portion.

19. The apparatus of claim 18 wherein said first frame portion and said second frame portion are connected by an articulating pin.

20. The apparatus of claim 19 wherein said first frame portion includes a tapered end and said second frame portion includes a tapered end.

* * * * *